US011447379B2

(12) United States Patent
Bell

(10) Patent No.: US 11,447,379 B2
(45) Date of Patent: Sep. 20, 2022

(54) MACHINE, CONTROLLER AND CONTROL METHOD

(71) Applicant: J.C. BAMFORD EXCAVATORS LIMITED, Uttoxeter (GB)

(72) Inventor: Samuel Josef Bell, Uttoxeter (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 265 days.

(21) Appl. No.: 16/597,833

(22) Filed: Oct. 9, 2019

(65) Prior Publication Data

US 2020/0109040 A1 Apr. 9, 2020

(30) Foreign Application Priority Data

Oct. 9, 2018 (GB) ..... 1816473

(51) Int. Cl.
*B66F 9/00* (2006.01)
*B66F 17/00* (2006.01)
*B66F 9/065* (2006.01)

(52) U.S. Cl.
CPC ..... *B66F 17/003* (2013.01); *B66F 9/0655* (2013.01)

(58) Field of Classification Search
CPC ..... B66F 17/00; B66F 17/003; B66F 9/00; B66F 9/06; B66F 9/065; B66F 9/0655
See application file for complete search history.

(56) References Cited

U.S. PATENT DOCUMENTS 4,006,347 A 2/1977 Hohmann
4,042,135 A 8/1977 Pugh et al.
5,058,752 A 10/1991 Wacht et al.
5,119,949 A 6/1992 Kishi
(Continued)

FOREIGN PATENT DOCUMENTS

DE 10115312 A1 10/2002
EP 0 059 901 B2 9/1996
(Continued)

OTHER PUBLICATIONS

Search Report for GB 1816473.1, dated Mar. 18, 2019.
Extended European Search Report for EP 19202301.8, dated Mar. 11, 2020.

*Primary Examiner* — James M McPherson
(74) *Attorney, Agent, or Firm* — Marshall, Gerstein & Borun LLP

(57) ABSTRACT

A controller for use with a machine includes a machine body, and a load handling apparatus coupled to the machine body and moveable by an actuator, wherein the controller is configured to receive a signal representative of the orientation of the load handling apparatus with respect to a reference orientation and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the orientation of the load handling apparatus with respect to the reference orientation.

28 Claims, 8 Drawing Sheets

(56) References Cited

U.S. PATENT DOCUMENTS

| | | | | |
|---|---|---|---|---|
| 5,147,172 | A | 9/1992 | Hosseini | |
| 5,224,815 | A | 7/1993 | Abels et al. | |
| 5,890,870 | A | 4/1999 | Berger et al. | |
| 8,070,413 | B2 | 12/2011 | Brooks et al. | |
| 8,965,637 | B2 | 2/2015 | Brooks et al. | |
| 9,073,739 | B2 * | 7/2015 | Woods | E02F 3/286 |
| 10,718,098 | B1 * | 7/2020 | Hager | E02F 3/431 |
| 2008/0263909 | A1 | 10/2008 | Schoenmaker et al. | |
| 2011/0150614 | A1 * | 6/2011 | Nicholson | E02F 3/431<br>414/685 |
| 2014/0058636 | A1 * | 2/2014 | Woods | E02F 3/286<br>701/50 |
| 2015/0176253 | A1 * | 6/2015 | Taylor | E02F 9/265<br>701/33.9 |
| 2018/0171578 | A1 * | 6/2018 | Smekal | E02F 3/431 |
| 2019/0033158 | A1 * | 1/2019 | Bonnet | B66C 23/44 |
| 2020/0248430 | A1 * | 8/2020 | Ito | E02F 3/435 |

FOREIGN PATENT DOCUMENTS

| | | | |
|---|---|---|---|
| FR | 2256101 | A1 | 7/1975 |
| GB | 930904 | A | 7/1963 |
| GB | 1 403 046 | A | 8/1975 |
| GB | 2483647 | A | 3/2012 |
| JP | 61-221099 | | 10/1986 |
| JP | 4-5491 | | 1/1992 |
| JP | 3252006 | B2 | 1/2002 |
| JP | 2002-128496 | A | 5/2002 |
| JP | 2006-16887 | A | 1/2006 |
| WO | WO-2012/035324 | A1 | 3/2012 |
| WO | WO-2015/192034 | A1 | 12/2015 |

* cited by examiner

MACHINE, CONTROLLER AND CONTROL METHOD

TECHNICAL FIELD

The present teachings relate to a controller for a machine including a load handling apparatus, a machine including such a controller, and a control method.

BACKGROUND

Machines including a load handling apparatus typically include a front and a rear axle supporting a machine body on which the load handling apparatus is mounted. Wheels are normally coupled to the front and rear axles, the wheels being configured to engage the ground and permit movement of the machine across the ground.

The load handling apparatus includes, for example, an extendable lifting arm moveable by one or more actuators with respect to the machine body. The lifting arm includes a load carrying implement to carry a load such that a load carried by the load carrying implement can be moved with respect to the machine body by the lifting arm.

Movement of the load produces a moment of tilt about an axis of rotation of one of the front or rear axles. Alternatively, a moment of tilt may be induced about another axis where, for example, stabilizers are used to stabilize the body relative to the ground during load handling operations.

Extension of the lifting arm in forwards direction, particularly when carrying a load, induces a moment of tilt about the axis of rotation of the front axle. As a result the portion of the machine (and load) weight supported by the rear axle decreases.

In order to ensure that the machine does not rotate about the front axle to such an extent that the wheels coupled to the rear axle are lifted from the ground surface (i.e. to ensure that the machine does not tip), when the load on the rear axle reduces to a threshold level, a safety control prevents or restricts the speed of further movement of the lifting arm. An example of such a machine can be found in EP1532065.

A problem arises because, in order to remain within safety limits, the threshold level which is selected for use by the safety control is overly restrictive for certain lifting arm positions—preventing the lifting arm from being moved into positions which do not actually risk the tipping of the machine.

If the machine is of a type that is expected to move over uneven ground, and so it cannot be assumed that the body of the machine is substantially horizontal to determine the safety limits, this may mean that the threshold for the safety limits has to be further restricted to take this possibility into account. This in turn may reduce the productivity of the load handling machine by slowing down cycle times or increasing the number of cycles required to complete a load handling operation.

It will be appreciated that this and similar problems apply to other machines too.

The present teachings seek to overcome or at least mitigate the problems of the prior art.

SUMMARY

According to an aspect of the teachings there is provided a controller for use with a machine comprising a machine body, and a load handling apparatus coupled to the machine body and moveable by a movement actuator with respect to the machine body, wherein the controller is configured to receive a signal representative of the orientation of the load handling apparatus with respect to a reference orientation and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the orientation of the load handling apparatus with respect to the reference orientation.

By reference orientation we mean an orientation that is fixed in space irrespective of the orientation of the machine itself. As such the orientation of the load handling apparatus can be considered to be an absolute orientation.

Advantageously the controller ensures the stability irrespective of the longitudinal inclination of a machine it controls, but does not unnecessarily restrict the productivity of the machine.

The element of the machine may include a movement actuator which, in response to the signal issued by the controller, is configured to restrict or substantially prevent a movement of the load handling apparatus.

The element of the machine may include an indicator of the machine which, in response to the signal issued by the controller, is configured to display and/or sound a warning.

This informs the operator when they operate the machine in a potentially unsafe manner.

The controller may be further configured to receive a signal representative of whether one or more stabilizers of the machine are deployed, and the threshold value may be further dependent on the signal representative of whether one or more of the stabilizers of the machine are deployed.

If a machine has stabilizers, the deployment thereof may require alteration of the threshold value, and therefore it is desirable for this to be signaled to the controller.

The signal representative of the orientation of the load handling apparatus may be a signal representative of an angle of the load handling apparatus with respect to the reference orientation.

The threshold may have a first value corresponding to a first orientation of the load handling apparatus with respect to the reference orientation and the threshold may have a second value corresponding to a second orientation of the load handling apparatus with respect to the reference orientation, the first value being less than the second value and the first orientation being lower than the second orientation.

For typical machine geometries a higher threshold value is usually required at higher orientations (e.g. larger angles with respect to a horizontal level).

The signal representative of the moment of tilt of the machine may be a signal representative of the load on an axle of the machine.

This is a reliable and cost effective way of deriving the moment of tilt.

The threshold value may include a first threshold value associated with one or more predetermined orientations of the load handling apparatus and a second threshold value associated with one or more other predetermined orientations of the load handling apparatus.

The threshold value may be proportional or substantially proportional to the signal representative of an orientation of the load handling apparatus over a range of orientations of the load handling apparatus.

The range of orientations of the load handling apparatus is between a first and a second orientation of the load handling apparatus, and at least one different threshold value is used when the position of the load handling apparatus is outside of the range.

The reference orientation may be gravity or a horizontal level.

Sensors able to measure with respect to these reference orientations are reliable and relatively low cost.

The controller may be further configured to receive a signal representative of a position of the load handling apparatus relative to the machine body.

The controller may be configured to issue a signal to set an interlock based on the position of the load handling apparatus relative to the machine body.

Setting interlocks with respect to a position relative to the machine body may be preferable in certain circumstances as they may be clearer to a machine operator during operation.

Another aspect provides a control system incorporating a controller according to the first aspect.

The control system may further comprise an absolute orientation sensor, for example an accelerometer or gyroscope, configured to send a signal representative of the orientation of the load handling apparatus with respect to a reference orientation.

Another aspect provides a machine including a controller or a control system as above.

The machine may further comprise a load handling apparatus and a machine body.

The load handling apparatus may be fixed against movement about an upright axis.

By being fixed in this way, the load handling apparatus cannot slew relative to the machine body. Machines that have the facility to slew in this way typically require a different load monitoring system that accounts for loads that may be laterally offset from a machine as well as being offset in a forward direction.

The load handling apparatus may comprise a lifting arm, the lifting arm optionally being at least pivotable with respect to the machine body.

The lifting arm may be pivotable about a substantially transverse axis of the machine and/or the lifting arm may extend substantially parallel to a longitudinal axis of the machine.

The lifting arm is optionally pivotable about a location between a longitudinal mid-point of the machine body and a rear of the machine body.

The lifting arm may be pivotable with respect to the machine body only about the substantially transverse axis.

A load handling implement may be mountable to the lifting arm forward of the machine body.

The machine may further comprise a ground engaging propulsion structure to permit movement thereof over the ground.

The ground engaging propulsion structure may comprise at least four wheels.

Two of the at least four wheels may be mounted to a front axle located between a longitudinal mid-point of the machine and a front of the machine.

Two of the at least four wheels may be mounted to a rear axle located between a longitudinal mid-point of the machine and a rear of the machine.

The machine may further comprise at least one stabilizer.

The at least one stabilizer may be capable of adopting a retracted position in which it is out of contact with the ground and a deployed position at which it is brought into contact with the ground to support at least a portion of the weight of the machine.

The at least one stabilizer may be mounted to the machine for deployment to the ground forward of the front axle.

The at least one stabilizer may lift the two wheels mounted to the front axle from the ground when in the deployed position.

The machine may have no stabilizer mounted to the machine for deployment to the ground rearwardly of the rear axle.

The only stabilizer or stabilizers mounted to the machine may be mounted for deployment to the ground forward of the front axle.

Another aspect provides a method of controlling a machine comprising a machine body, and a load handling apparatus coupled to the machine body and moveable with respect to the machine body, the method comprising: receiving a signal representative of the orientation of the load handling apparatus with respect to a reference orientation and a signal representative of a moment of tilt of the machine; comparing signal representative of the moment of tilt with a threshold value, the threshold value being dependent on the signal representative of the orientation of the load handling apparatus with respect to the reference orientation; and issuing a signal for use by an element of the machine to restrict or substantially prevent a movement of the load handling apparatus in response to the issued signal when the signal representative of the moment of tilt reaches the threshold value.

Advantageously the method ensures the stability irrespective of the longitudinal inclination of a machine it controls, but does not unnecessarily restrict the productivity of the machine.

The method may further include restricting or substantially preventing a movement of the load handling apparatus in response to the issued signal.

The method may further include displaying and/or sounding a warning in response to the signal issued by the controller.

The method may further include receiving a signal representative of whether one or more stabilizers of the machine are deployed, wherein the threshold value may be further dependent on the signal representative of whether one or more of the stabilizers of the machine are deployed.

The signal representative of the orientation of the load handling apparatus may be a signal representative of an angle of rotation of a lifting arm of the load handling apparatus with respect to the reference orientation.

The signal representative of the moment of tilt of the machine may be a signal representative of the load on an axle of the machine.

The threshold value may include a first threshold value associated with one or more predetermined orientations of the load handling apparatus and a second threshold value associated with one or more other predetermined orientations of the load handling apparatus.

The threshold value may be proportional or substantially proportional to the signal representative of an orientation of the load handling apparatus over a range of positions of the load handling apparatus.

The range of orientations of the load handling apparatus is between a first and a second orientation of the load handling apparatus, and at least one different threshold value is used when the orientation of the load handling apparatus is outside of the range.

BRIEF DESCRIPTION OF THE DRAWINGS

Embodiments will now be described, by way of example only, with reference to the accompanying drawings, in which.

DETAILED DESCRIPTION

Figure 1:
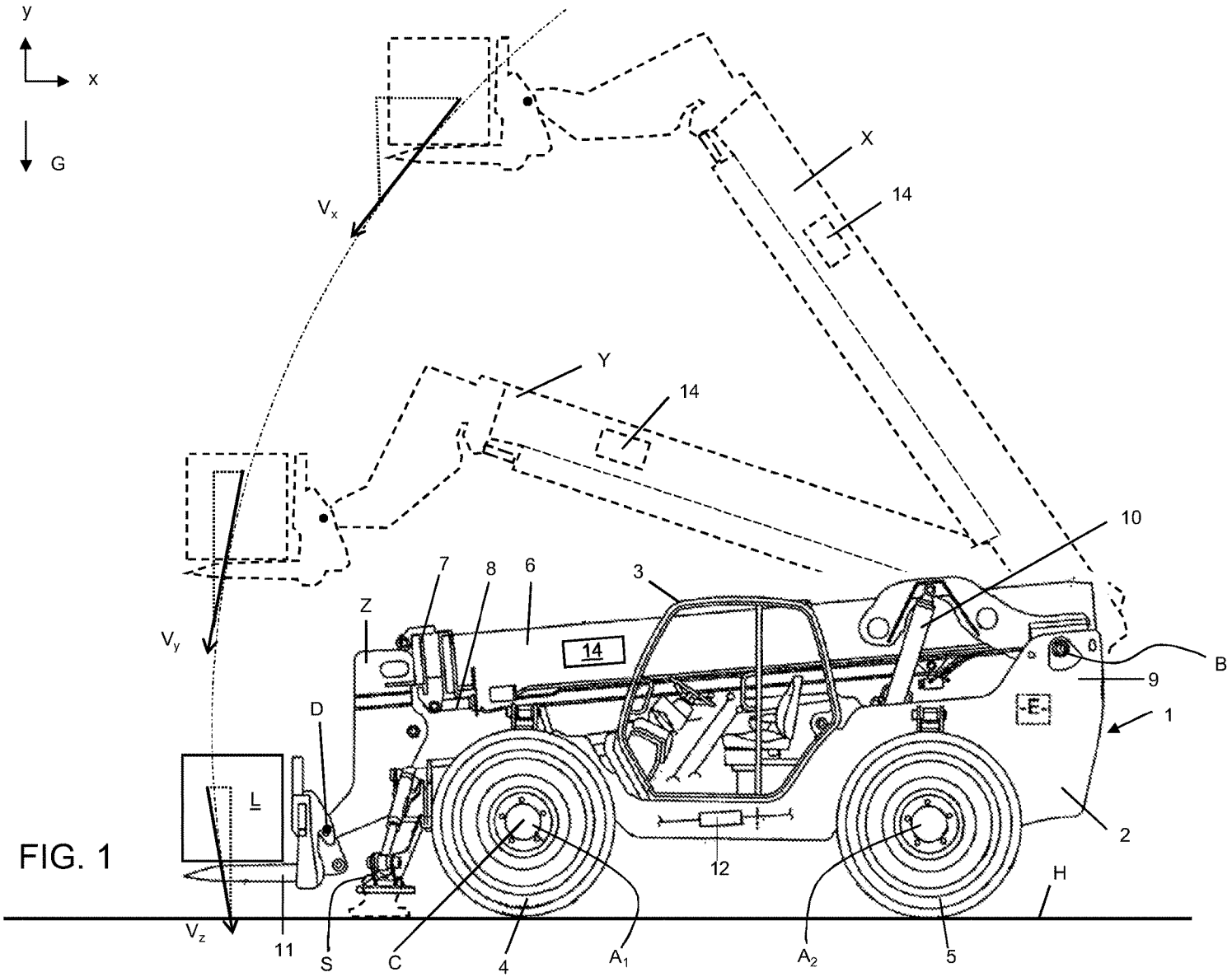
FIG. 1 is a side view of a machine on horizontal ground.

With reference to FIG. 1, an embodiment of the teachings includes a machine 1 which may be a load handling machine. In this embodiment the load handling machine is a telescopic handler. In other embodiments the load handling machine may be a skid-steer loader, a compact track loader, a wheel loader, or a telescopic wheel loader, for example. Such machines may be denoted as off-highway working machines. The machine 1 includes a machine body 2 which may include, for example, an operator's cab 3 from which an operator can operate the machine 1.

In an embodiment, the machine 1 has a ground engaging propulsion structure comprising a first axle A1 and a second axle A2, each axle being coupled to a pair of wheels (two wheels 4, 5 are shown in FIG. 1 with one wheel 4 connected to the first axle A1 and one wheel 5 connected to the second axle A2). The first axle A1 may be a front axle and the second axle A2 may be a rear axle. One or both of the axles A1, A2 may be coupled to an engine E which is configured to drive movement of one or both pairs of wheels 4, 5. Thus, the wheels may contact a ground surface H and rotation of the wheels 4, 5 may cause movement of the machine with respect to the ground surface. In other embodiments the ground engaging propulsion structure comprises tracks.

In an embodiment, at least one of the first and second axles A1, A2 is coupled to the machine body 2 by a pivot joint (not shown) located at substantially the center of the axle such that the axle can rock about a longitudinal axis of the machine 1—thus, improving stability of the machine 1 when moving across uneven ground. It will be appreciated that this effect can be achieved in other known manners.

A load handling apparatus 6, 7 is coupled to the machine body 2. The load handling apparatus 6, 7 may be mounted by a mount 9 to the machine body 2. In an embodiment, the load handling apparatus 6, 7 includes a lifting arm 6, 7.

The lifting arm 6, 7 may be a telescopic arm having a first section 6 connected to the mount 9 and a second section 7 which is telescopically fitted to the first section 6. In this embodiment, the second section 7 of the lifting arm 6, 7 is telescopically moveable with respect to the first section 6 such that the lifting arm 6, 7 can be extended and retracted. Movement of the first section 6 with respect to the second section 7 of the lifting arm 6, 7 may be achieved by use of an extension actuator 8 which may be a double acting hydraulic linear actuator. One end of the extension actuator 8 is coupled to the first section 6 of the lifting arm 6, 7 and another end of the extension actuator 8 is coupled to the second section 7 of the lifting arm 6, 7 such that extension of the extension actuator 8 causes extension of the lifting arm 6, 7 and retraction of the extension actuator 8 causes retraction of the lifting arm 6, 7. As will be appreciated, the lifting arm 6, 7 may include a plurality of sections: for example, the lifting arm 6, 7 may comprise two, three, four or more sections. Each arm section may be telescopically fitted to at least one other section.

The lifting arm 6, 7 can be moved with respect to the machine body 2 and the movement is preferably, at least in part, rotational movement about the mount 9 (about pivot B of the lifting arm 6, 7). The rotational movement is about a substantially transverse axis of the machine 1, the pivot B being transversely arranged.

Rotational movement of the lifting arm 6, 7 with respect to the machine body 2 is, in an embodiment, achieved by use of at least one lifting actuator 10 coupled, at one end, to the first section 6 of the lifting arm 6, 7 and, at a second end, to the machine body 2. The lifting actuator 10 is a double acting hydraulic linear actuator, but may alternatively be single acting.

FIG. 1 shows the lifting arm 6, 7 positioned at three positions, namely X, Y and Z, with positions X and Y shown in dashed lines in simplified form. When positioned at position X the angle between the lifting arm and a ground level is 55 degrees. This angle is measured with respect to the longitudinal major portion of the lifting arm 6, 7, i.e. the part that extends and retracts if the arm is telescopic. In other embodiments, a different measure of the angle may be used, for example and angle defined using notional line between the pivot B and the pivot D for the load handling implement (see below). When positioned at position Y the angle is 27 degrees. When positioned at position Z the angle is −5 degrees. 55 degrees and −5 degrees represent the upper and lower limits of angular movement for the machine 1 with stabilizers retracted. The upper limit may be permitted to be increased to, say, 70 degrees when the stabilizers are deployed to contact the ground (see below). Clearly, the lifting arm can be positioned at any angle between these limits. Other machines may have different upper and lower angular limits dependent upon the operational requirements of the machine (maximum and minimum lift height and forward reach etc.) and the geometry of the machine and load handling apparatus (e.g. position of pivot B, dimensions of cranked portion at the distal end of the second section 7 of the lifting arm 6, 7). As will be appreciated, when the lifting arm is positioned relatively close to the ground it is at a relatively small angle and when it is positioned relatively remotely from the ground it is at a relatively large or high angle.

A load handling implement 11 may be located at a distal end of the lifting arm 6, 7. The load handling implement 11 may include a fork-type implement which may be rotatable with respect to the lifting arm 6, 7 about a pivot D, this pivot also being transversely arranged. Other implements may be fitted such as shovels, grabs etc. Movement of the load handling implement 11 may be achieved by use of a double acting linear hydraulic actuator (not shown) coupled to the load handling implement 11 and the distal end of the section 7 of the lifting arm 6, 7.

Off-highway machines 1 of the teachings are configured to transport loads L over uneven ground, i.e. with a load held by the load handling implement 11, an operator controls the propulsion structure to move the entire machine with the load from one location to another.

This may be contrasted with machines such as mobile cranes and roto-telehandlers in which a boom is pivotable about both a lateral and an upright axis—i.e. the boom can slew relative to a machine body on a turret or turntable—as well as pivot upwards about the lateral axis. Such machines may be driven to a particular location and are immobilized on four or more stabilizer legs to lift the wheels or other propulsion means entirely off the ground, and to ensure the upright slew axis is absolutely vertically aligned. From that fixed location the machine will move a load from one location to another location using a movements of the boom about the lateral and upright axes. As such, different stability considerations apply to machines in which a boom can also move about an upright axis. Therefore different safety legislation, and consequently different safety systems, are employed on such machines.

When the machine 1 lifts a load L supported by the load handling implement 11, the load L (and implement 11) will produce a moment about an axis of the machine 1 which causes the machine to tend to tilt about that axis. The moment is, therefore, referred to herein as a moment of tilt. In the depicted example, this axis of the machine 1 about which the machine 1 is likely to tilt is axis C—i.e. about the first (or front) axle A1.

Figure 3:
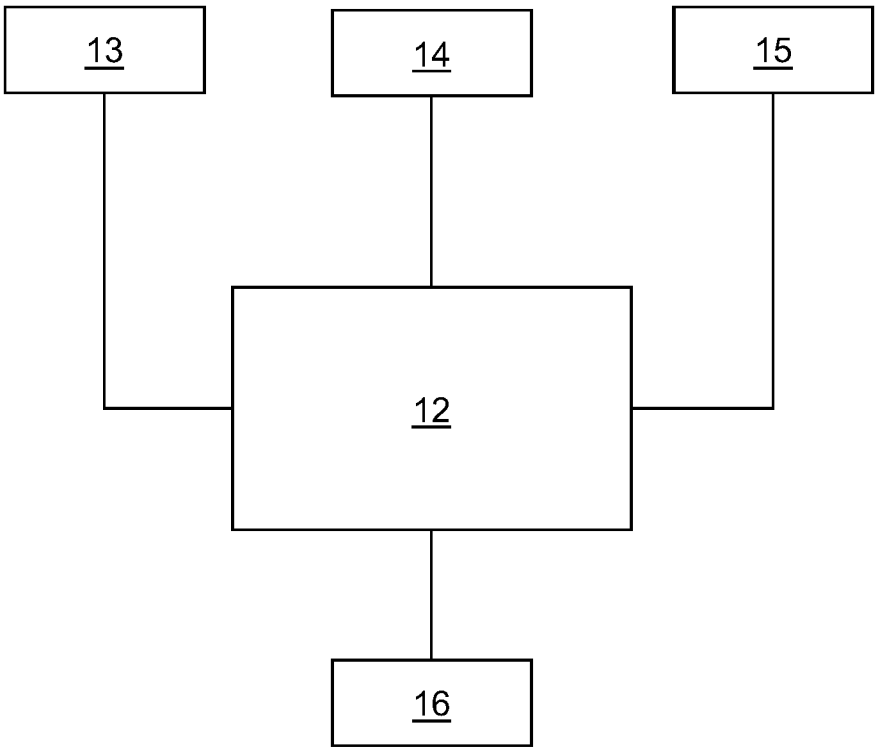
FIG. 3 is a control system.

A tilt sensing arrangement 13 (see FIG. 3) is provided and is configured to sense a parameter which is representative of a moment of tilt of the machine 1 about an axis.

The tilt sensing arrangement 13 is further configured to issue a signal to the controller 12 such that a moment of tilt of the machine about an axis can be determined. In an embodiment, the tilt sensing arrangement 13 includes a strain gauge coupled to an axle A1, A2 of the machine 1. In an embodiment, the tilt sensing arrangement 13 includes a load cell located between the machine body 2 and an axle and configured to sense the load (or weight) on the axle. The tilt sensing arrangement 13 may be coupled to or otherwise associated with the second (or rear) axle A2.

The tilt sensing arrangement 13 may, in an embodiment, include several sensors which sense different parameters and use these parameters to generate a signal such that a moment of tilt of the machine 1 can be determined.

The tilt sensing arrangement 13 may take other forms, as will be appreciated.

An orientation sensor arrangement 14 (see FIGS. 1-3) is also provided and is configured to sense a parameter representative of a position of at least a portion of the load handling apparatus 6, 7 with respect to a reference orientation. For example this reference orientation may be horizontal ground H (a horizontal reference datum) or the direction of the force due to gravity G (a vertical reference datum and hereinafter referred to as "gravity"). In other words the orientation sensor arrangement senses the absolute orientation of the load handling apparatus 6, 7 in space, rather than its position relative to another body, such as the machine body 2. For example this may be an angle of the load handling apparatus 6, 7 with respect to gravity G (an absolute vertical orientation) or an angle with respect to horizontal ground H (an absolute horizontal orientation) irrespective of the inclination of the machine body 2.

The orientation sensor arrangement 14 is further configured to issue a signal to the controller 12 representative of an orientation of at least a portion of the load handling apparatus 6, 7 with respect to the reference orientation H, G.

The orientation sensor arrangement 14 may be an accelerometer or gyroscope 14 mounted to or otherwise associated with the load handling apparatus 6, 7 and configured to change its output signal by movement of the load handling apparatus 6, 7 with respect to the machine body 2 and by a change in inclination of the machine body 2 with respect to the reference orientation H, G. In practical terms the accelerometer 14 is a solid state electronic sensor that senses its orientation with respect to gravity G. However, since horizontal ground H can be assumed to be normal to gravity G, the controller 12 or accelerometer 14 is able to convert an orientation with respect to gravity G into an orientation with respect to horizontal ground H. For ease of understanding, the present teachings are described taking the reference orientation as being horizontal ground H.

In alternative embodiments, the orientation sensor arrangement 14 may include an accelerometer mounted to the machine body 2 to sense the inclination of the machine body 2 with respect to the reference orientation H and a sensor configured to measure the position of the load handling apparatus 6, 7 with respect to the machine body 2. The sensor may be a potentiometer mounted proximate to the pivot B with one portion fixed to the machine body 2 and a separate moveable portion fixed to the load handling apparatus 6, 7. As the load handling apparatus 6, 7 moves and its position changes with respect to the machine body 2, the resistance of the potentiometer changes to provide a signal that can be related to the position—e.g. the resistance may be proportional to the angle of the load handling apparatus 6, 7 with respect to the machine body 2.

Alternatively, the position sensor may be a series of markings on a part of the lifting actuator 10 and a reader configured to detect the or each marking. The lifting actuator 10 may be arranged such that extension of the lifting actuator 10 causes one or more of the series of markings to be exposed for detection by the reader. If the position of the markings on the actuator 10 is known, then the extension of the lifting actuator 10 can be determined. The absolute orientation of the load handling apparatus 6, 7 may then be derived by summing the absolute orientation of the machine body 2 with respect to the reference orientation H, G and the relative position of the load handling apparatus 6, 7 with respect to the machine body 2.

It will be appreciated that other orientation sensor arrangements are possible.

In an embodiment, the orientation sensor arrangement 14 is configured to issue a signal representative of an angle of a lifting arm 6, 7 of the load handling apparatus 6, 7 with respect to the reference orientation H, G. In an embodiment, this signal may be the absolute angle of the lifting arm 6, 7 with respect to the reference orientation H, G.

A controller 12 (see FIGS. 1 to 3) is provided which is configured to receive a signal from the tilt sensing arrangement 13 and the orientation sensor arrangement 14—these signals being representative of an absolute orientation of the load handling apparatus 6, 7 and a moment of tilt of the machine 1. The controller 12 may be any suitable microprocessor type controller and the signals may be transmitted by any suitable wired or wireless communication system or protocol, such as via a CAN bus of the machine 1.

The controller 12 is coupled to at least one actuator 8, 10 which controls at least one movement of the load handling apparatus 6, 7 with respect to the machine body 2. The controller 12 is configured to issue a signal to stop or restrict (e.g. slow to a velocity lower than the desired velocity that is input by a machine operator) a movement of the load handling apparatus 6, 7 when a condition or conditions are met—as described below.

When a load L is supported by the load handling implement 11, the weight of the load L is counterbalanced by the weight of the machine 1. However, if the moment of tilt increases, the machine 1 may become unstable as the weight on the second axle decreases—i.e. the machine 1 may tip about axis C.

The controller 12 of the machine 1 is configured to receive a signal indicative of the moment of tilt—which may, for example, be the load (or weight) on the second (or rear) axle A2. In addition, the controller 12 is configured to receive a signal indicative of an orientation of the load handling apparatus—for example the angle of the lifting arm 6, 7 with respect to the reference orientation H, G—e.g. horizontal ground H.

With reference to FIG. 1 the vectors depicting the path of the load at positions X, Y and Z are shown by arrows Vx, Vy, and Vz. The x and y components of these vectors are denoted by the dotted lines forming a right angle triangle with each arrow with the x component being parallel to horizontal ground H and the y component being parallel to gravity G. Thus it can be seen that at position X of the load handling apparatus 6, 7 the negative x component of the vector is greater for a given negative y component, than at position Y, and at position Z there is a small positive x component for a given negative y component. Therefore at position X, for a given angular velocity of the load handling apparatus, there is a greater negative linear velocity of the load L in axis x. In this embodiment in practical terms this means that the load moves forward faster when lowering the load handling apparatus from larger angles than smaller angles. In turn this means that the tipping moment relative to the axis C is increasing at a faster rate and consequently the longitudinal or forward inertia that would be generated in the load L and load handling apparatus 6, 7 if there is an abrupt cessation of movement (i.e. the operator suddenly stops lowering the load L) is greater in position X than in positions Y and Z.

Thus, to counteract this issue, one measure is to require a greater threshold load on the second axle A2 to provide a suitable safety margin in all operating conditions. However such a safety margin may be excessive in positions Y and Z, and so the machine 1 may be prevented from carrying out operations that are safe in these positions if such a threshold is present. As such the productivity of the machine for carrying out certain operations may be reduced.

In an embodiment (see FIG. 7 for example), the controller 12 includes a first and a second stored threshold value TV1 and TV2—the first and second threshold values being different. When the signal representative of an orientation of the load handling apparatus 6, 7 indicates that the load handling apparatus 6, 7 is in a first orientation with respect to the horizontal ground H, the controller compares the signal representative of the moment of tilting with the first threshold value TV1. The controller 12 may then issue a signal or command to restrict or substantially prevent a movement of the load handling apparatus 6, 7 if, for example, the signal representative of the moment of tilting is close to or is approaching the first threshold value TV1.

When the signal representative of an orientation of the load handling apparatus 6, 7 indicates that the load handling apparatus 6, 7 is in a second orientation with respect to horizontal ground H, the controller compares the signal representative of the moment of tilting with the second threshold value TV2. The controller 12 may then issue a signal or command to restrict or substantially prevent a movement of the load handling apparatus 6, 7 if, for example, the signal representative of the moment of tilting is close to or is approaching the second threshold value TV2.

Restricting or substantially preventing a movement of the load handling apparatus 6, 7 may include, for example, restricting or stopping the flow of hydraulic fluid into and out of a movement actuator such as the lifting actuator 10. In an embodiment, restricting or substantially preventing a movement of the load handling apparatus 6, 7 includes restricting or substantially preventing a movement of the load handling apparatus 6, 7 in one or more directions. In an embodiment in which the load handling apparatus 6, 7 includes a lifting arm 6, 7, restricting or substantially preventing a movement of the lifting arm 6, 7 may prevent lowering of the arm 6, 7 but may allow raising and/or retraction of the lifting arm 7. In a further embodiment, restricting movement of the load handling apparatus may further include restricting the forward or reverse motion of the machine 1 as a whole.

Thus, the threshold value which is used for the comparison by the controller 12 is dependent on the orientation of the load handling apparatus 6, 7. This dependency may take many different forms—see below.

Restricting or substantially preventing a movement of the load handling apparatus 6, 7 is intended to seek to reduce the risk of the machine tipping by preventing or restricting a movement which would otherwise tip—or risk tipping—the machine 1. The use of a threshold value TV1 TV2 which is dependent on an orientation of the load handling apparatus 6, 7 is intended to seek to avoid restricting movement of the load handling apparatus 6, 7 needlessly when there is little or no risk of tipping the machine 1 or moving out of safety limits.

The restriction or substantial prevention of a movement of the load handling apparatus 6, 7 may include, for example, the progressive slowing of a movement of at least a part of the load handling apparatus 6, 7—for example, slowing the speed of movement of a lifting arm 6, 7 to a stop.

In an embodiment, the first and second threshold values TV1 and TV2 are selected dependent on the orientation of the load handling apparatus 6, 7. A single threshold value may apply to several different orientations of the load handling apparatus 6, 7 with respect to horizontal ground H. The threshold values may be proportional to or substantially proportional to an orientation of the load handling apparatus 6, 7 with respect to horizontal ground H—for example, an angular orientation of a lifting arm 6, 7 of the load handling apparatus 6, 7 with respect to horizontal ground H (see FIGS. 5 and 6). The proportional or substantially proportional dependency of the threshold value on the orientation of the load handling apparatus 6, 7 may be limited to a range of orientations of the load handling apparatus 6, 7 (see FIG. 6) or may be over the entire range of permitted or possible orientations of the load handling apparatus 6, 7 (see FIG. 5).

For example, the machine 1 may have a load handling apparatus 6, 7 which includes a lifting arm 6, 7 and orientation sensor arrangement 14 may include a sensor configured to sense the angle of the lifting arm 6, 7 with respect to horizontal ground H (or a parameter representative of the angle of the lifting arm 6, 7). The threshold value used by the controller 12 may be selected dependent on the angle of the lifting arm 6, 7 with respect to horizontal ground H. A first threshold value TV1 may be used for angles below a lower limit and a second threshold value TV2 may be used for angles above an upper limit. If the lower and upper limits are at different angles, then a variable threshold value may be used between the upper and lower limits (the variable threshold value may be proportional to the orientation of the lifting arm 6, 7). The first threshold value TV1 is preferably lower than the second threshold value TV2.

In an embodiment, there is a plurality of threshold values each with a respective load handling apparatus orientation associated therewith. The threshold values and associated load handling apparatus orientations may be stored in a lookup table which can be accessed by the controller 12.

In an embodiment, the load sensor arrangement senses the weight on the second (or rear) axle A2 of the machine 1. In this example embodiment, a typical load on the second axle of the machine 1 is 4000 kg to 6000 kg. A first threshold value for the controller 12 is selected to be about 1000 kg for lifting arm angles with respect to the horizontal (with the machine in an typical orientation) of less than about 30° (or less than about 20°-25° in another example), a second threshold value is selected to be about 3500 kg for lifting arm angles with respect to the horizontal of greater than about 45° (or greater than about 40° in another example). The threshold value for any angles between these angles (e.g. between 30° and 45° in one example) may be proportional or substantially proportional to the angle such that there is a substantially linear progression of the threshold value for a given angle from the first to the second threshold value between the specified angles (e.g. between 30° and 45° in one example).

The threshold values used for a particular machine will be dependent on the machine characteristics. For example, the threshold values may be dependent on the geometry of the machine, the mass of the machine, the geometry and mass of the load handling apparatus 6, 7. Further, for machines in which the load handling apparatus 6, 7 is telescopically extendible, a given angular velocity will result in a differing x and y component of linear velocity dependent upon the extension of the load handling apparatus. As such an extension sensor arrangement (not shown) may also signal the controller and the controller may adjust the threshold value according to the extension. The threshold values are selected in an attempt to prevent tipping of the machine during operation.

It will be appreciated that the selection of a threshold value for the moment of tilt dependent on the orientation of the load handling apparatus 6, 7 allows the machine 1 to operate safely within a full range of movement.

Figure 5:
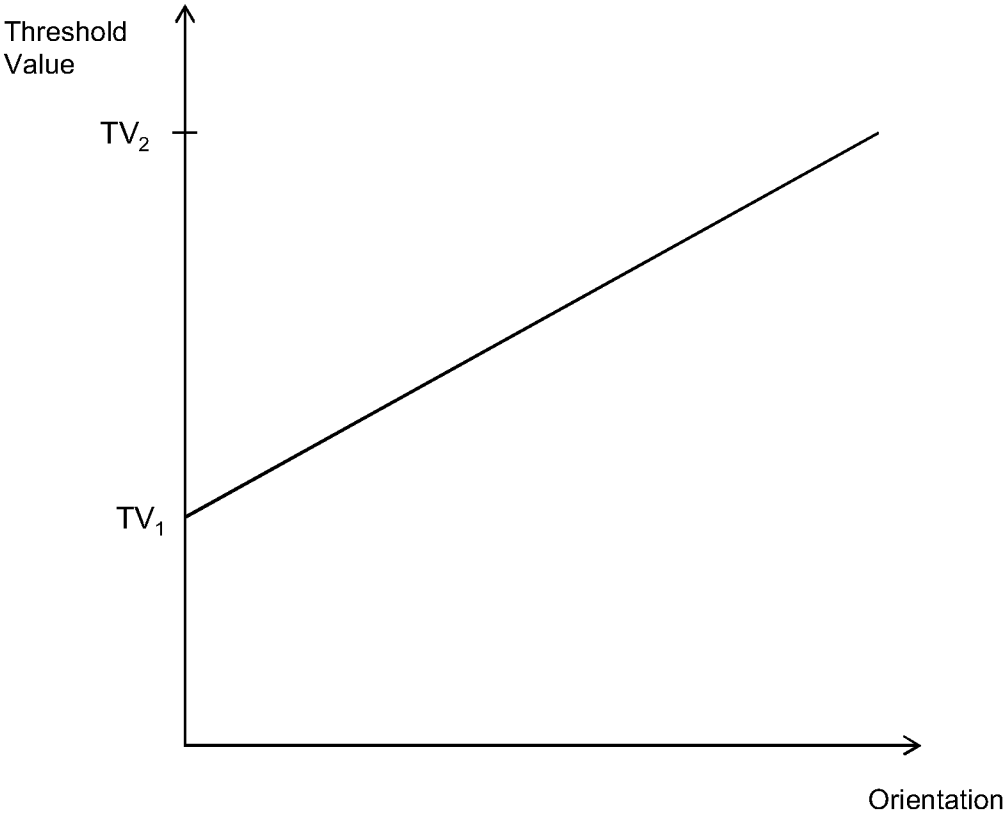
FIGS. 5 to 7 are charts illustrating relationships between load handling apparatus orientation and threshold value.
Figure 6:
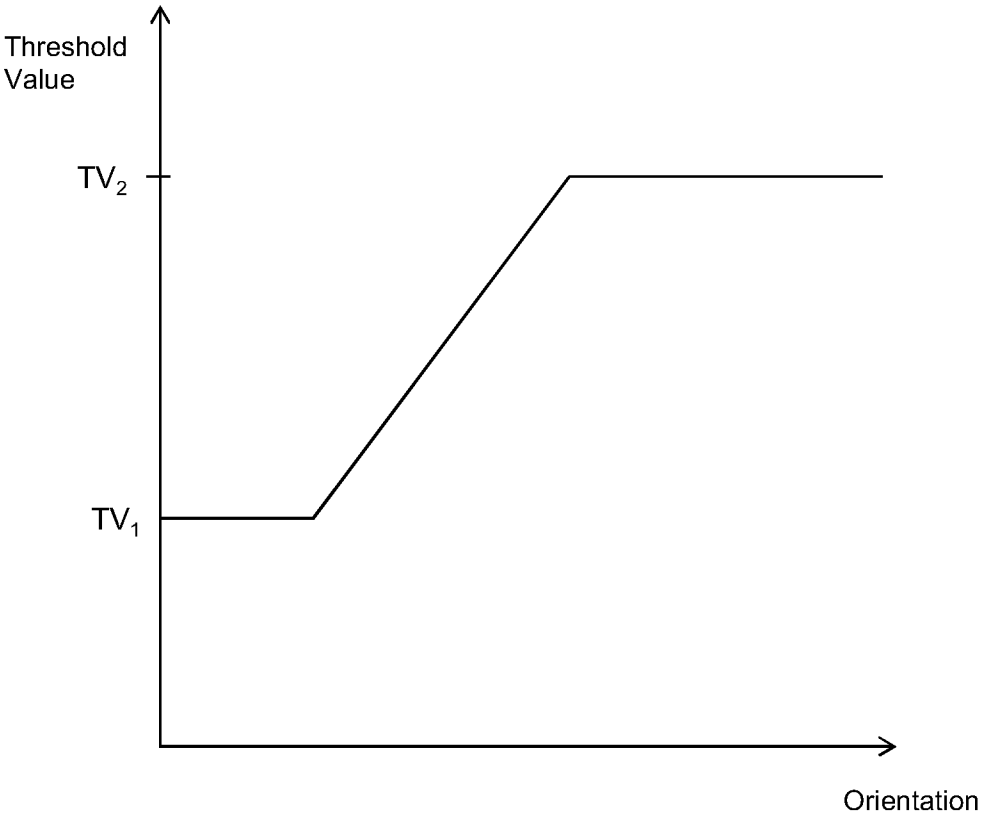
Figure 7:
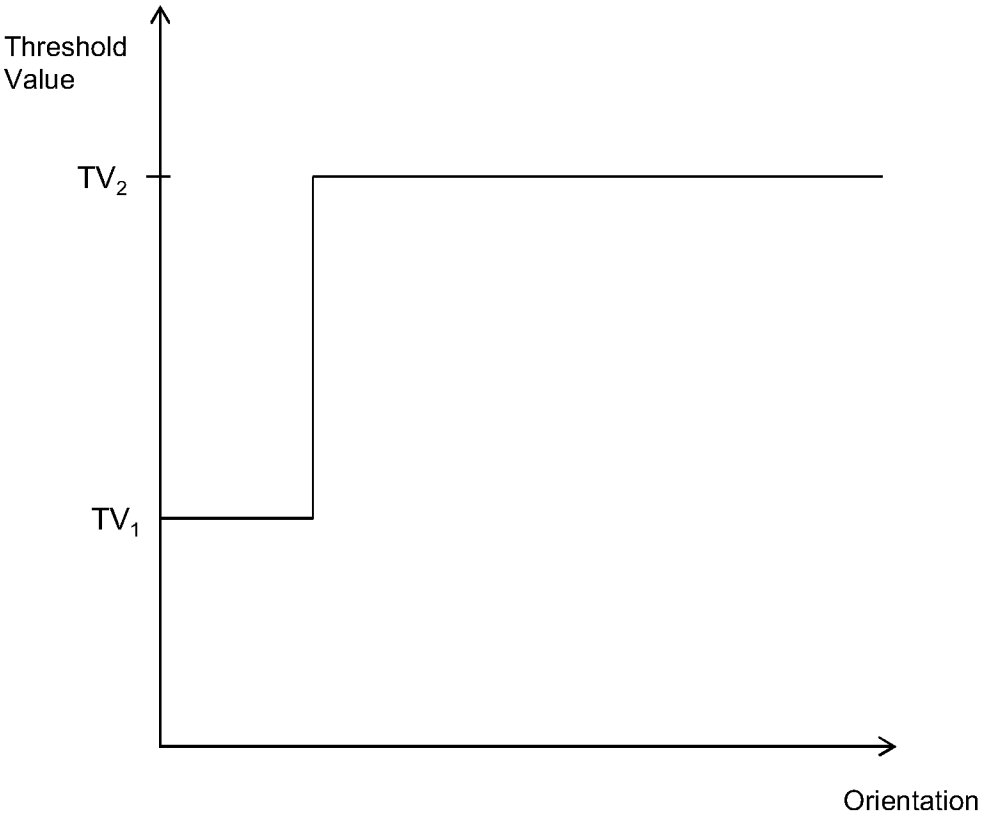
Figure 8:
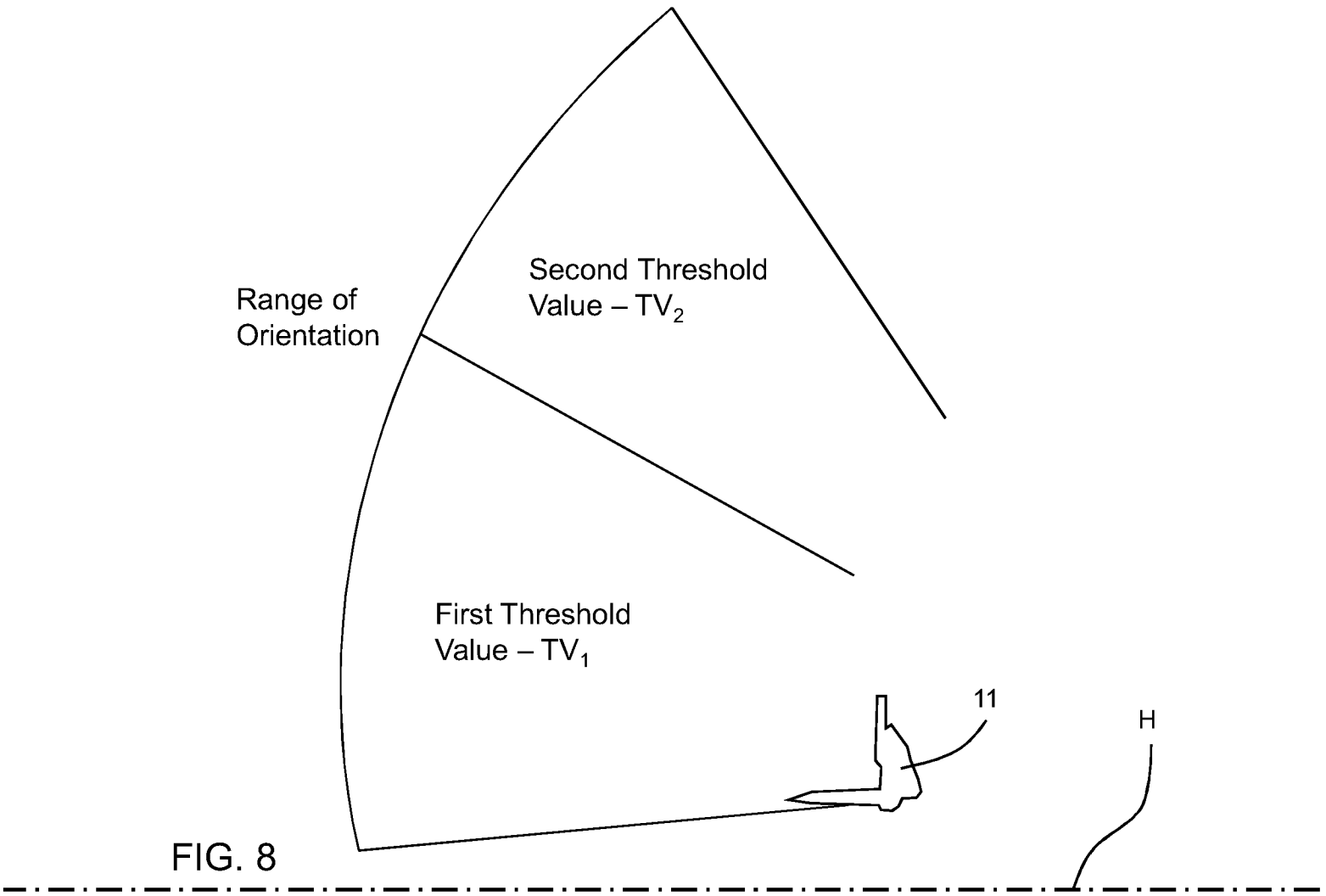
FIG. 8 is a diagram illustrating the relationship of orientation of a load handling apparatus to threshold value for the chart of FIG. 7.

FIGS. 5 to 7 show a selection of examples of possible threshold values for different load handling apparatus orientations. In FIG. 5, the threshold value is proportional to the orientation of the load handling apparatus 6, 7. In FIG. 6, a first threshold value TV1 is used for a first range of orientations of the load handling apparatus 6, 7, a second threshold value TV2 is used for a second range of orientations of the load handling apparatus 6, 7, and the threshold value used for a given orientation of the load handling apparatus 6, 7 between the first and second ranges varies in proportion to the orientation of the load handling apparatus 6, 7. The proportional relationship may be directly proportional or proportional in accordance with a trigonometric function (such as a tangential function) or other mathematical relationship for example. In FIG. 7, a first threshold value TV1 is used for a first range of orientations of the load handling apparatus 6, 7, a second threshold value TV2 is used for a second range of orientations of the load handling apparatus 6, 7. FIG. 8 is another representation of the relationship shown in FIG. 7 in the specific example of a load handling apparatus 6, 7 comprising a lifting arm 6, 7 which can move (about pivot B) with respect to the machine body 2 over a range of possible angles—with a first threshold value TV1 being used over a first range of angular movement and a second threshold value TV2 being used over a second range of angular movement.

As depicted in FIG. 1 it is apparent that the actual ground upon which the machine is supported is level or horizontal (i.e. normal to gravity G). The operating instructions of machines 1 of the type described in these teachings typically indicate that lifting and lowering operations of the type described should be undertaken on horizontal ground only.

However it is sometimes the case that operators are unaware of, or choose to disregard, such instructions and manipulate loads with the machine 1 stood on inclined surfaces. Such a risk is heightened for machines of the type described—i.e. off-highway working machines including telescopic handlers, skid-steer loaders, compact track loaders, wheel loaders, or telescopic wheel loaders—since such machines are typically capable of working off-road in construction, agricultural or military environments, As such they are typically equipped with one or more of the following features: deep treaded tires, tracks, high ground clearance to the machine body, steep approach and departure angles, limited slip differentials, locking differentials and drive to all wheels or tracks to improve their traction and ability to drive up and crest inclines.

Figure 2:
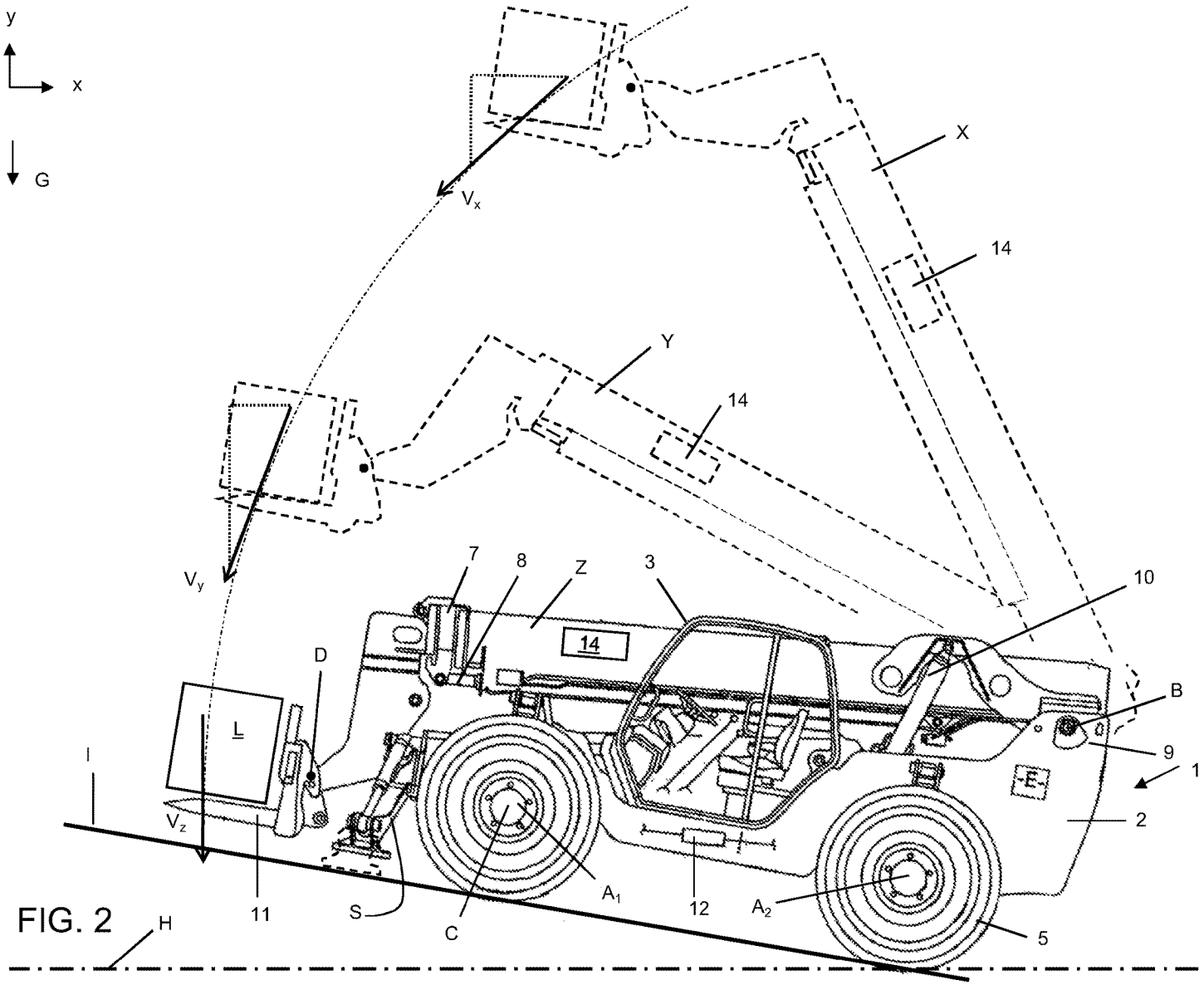
FIG. 2 is a side view of the same machine on an incline.

FIG. 2 depicts the machine 1 on an upwardly inclined surface I of approximately 10 degrees, and with the load handling apparatus 6, 7 inclined to the same position as depicted in FIG. 1 relative to the machine body 2, but at orientations of approximately 65 degrees, 37 degrees and 5 degrees with respect to horizontal ground H.

By a comparison of FIGS. 1 and 2 it can be seen that the negative x component of the vectors Vx and Vy is now greater due to the incline of the machine. In the case of the component at position Y, the negative x component is approximately twice as large as in FIG.

The reverse is applicable if the machine 1 is operated on a downwardly inclined surface.

As such, the benefit of sensing an absolute orientation of the load handling apparatus 6, 7 can be appreciated since it enables the threshold values to be based on an accurate measure of the forward component of the movement vector of the load L, irrespective of the inclination of the machine 1. To some extent variations in the tilt sensing arrangement 13 caused by an incline compensate for inaccuracies in threshold value calculations if they are based on the relative position of a load handling apparatus 6, 7 to a machine body 2. Nevertheless the present teachings permit a more refined system overall, that allows for greater machine productivity.

A further benefit of measuring an absolute orientation of the load handling apparatus 6, 7 is that accelerometers utilized for such measurements can have no moving parts and can be mounted in a variety of locations on the load handling apparatus that can be selected to be away from areas prone to damage. This is in contrast to potentiometers that are typically used for relative measurement of a load handling apparatus which inevitably comprise moving parts and must be mounted where the load handling apparatus 6, 7 is mounted to the machine body 2 where it may be more prone to damage.

It will be appreciated that as a load L is lowered and moves forward with respect to the machine body 2, the proportion of that load transmitted to the ground at a rearward end of the machine 1 reduces and the proportion transmitted at the forward end increases. For example, for machines having two wheels 4 mounted on a front axle A1 and two wheels 5 mounted on a rear axle A2, progressively more weight will be transmitted via the two front wheels 4 and progressively less via the rear wheels 5 during lowering. In particular, but not exclusively, for wheels fitted with pneumatic tires, this load transfer will tend to cause the front tires to compress slightly and the rear tires to expand slightly. If the machine 1 is stood on a compressible surface such as earth, it may also cause the front wheels to sink into the surface to some degree. As a result, the machine body may tilt forwards as a result of the lowering. A further benefit of sensing absolute orientation is that such movements caused by this load transfer are also corrected for.

A still further benefit of measuring absolute orientation is that this provides a closer correlation to manual load charts and corresponding visual indications (pendulum indicators) for a machine operator that are often mounted on to a load handling apparatus and indicate the orientation of the load handling apparatus and thus related permissible loads for the machine with respect to an absolute orientation, typically level ground.

In an embodiment, the machine 1 includes one or more stabilizers S which may be extended (deployed) or retracted from the machine body 2. The or each stabilizer S preferably extends from a part of the machine body 2 which is towards the load handling implement 11 of the machine 1. There are preferably two stabilizers S and each stabilizer is preferably located adjacent to a wheel which is coupled to the first (or front) axle.

The or each stabilizer S is configured to be extended such it makes contact with a ground surface (as depicted in broken lines in FIGS. 1 and 2) and restricts movement of the machine 1 about an axis (for example axis C) which may be induced by the moment of tilt caused by the load L. In other words, lowering the stabilizers S into contact with the ground moves the tipping axis forwards, so the machine 1 provides a greater counterbalancing moment and the tipping moment of the load L, load handling implement 11 and load handling apparatus 6, 7 is reduced, resulting in a greater forward stability for a given load weight and location.

For machines 1 of the teachings it is typically not required for there to be further stabilizers adjacent to or rearward of the rear axle. This is because such stabilizers would not offer an appreciable increase in forward stability and there is typically no requirement for rearward stability since the load would not ordinarily placed in a position where it overhangs a rear of the machine.

In other words, an optimal forward stability can be achieved by the front of the machine being supported on the stabilizer(s) S and the rear of the machine is supported on the wheels 5 mounted to axle A2.

If the machine 1 includes one or more stabilizers S, then the controller 12 may be further configured to receive a signal from a stabilizer sensor arrangement 15 (see FIG. 3), the signal being representative of whether or not the or each stabilizer has been deployed. If the or each stabilizer S has been deployed, then the threshold values used by the controller 12 may be different from those which are used without the or each stabilizer S deployed. The controller 12 may include a first set of threshold values for when the or each stabilizer S is not deployed and a second set of threshold values for when the or each stabilizer S is deployed. The threshold values used when the or each stabilizer S is deployed may generally follow the same principles as discussed above for the case when the or each stabilizer S is either not present or not deployed. The description above relating to the threshold value applies equally to the threshold value when the or each stabilizer S is deployed. The threshold values used when the or each stabilizer S is deployed may be higher than the threshold values used for corresponding orientations of the load handling apparatus 6, 7 when the or each stabilizer S is not deployed.

Figure 4:
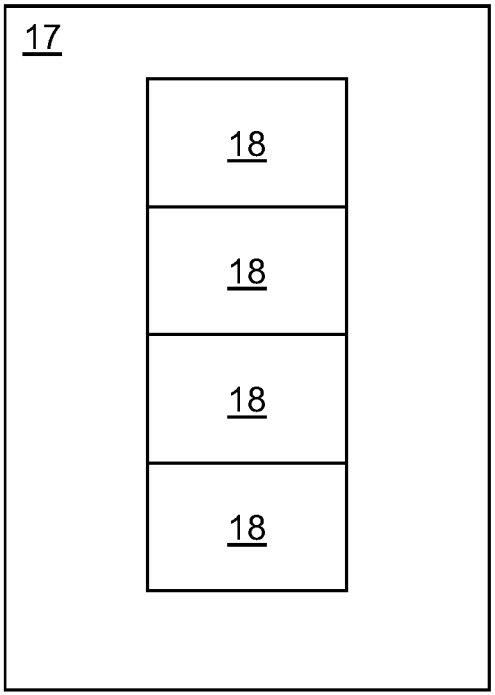
FIG. 4 is an indicator.

In an embodiment, an indicator 17 (see FIG. 4) is provided in the cab 3 for the operator. The indicator 17 may be a visual indicator or an audible indicator or both. The indicator 17 preferably includes a plurality of lights 18 (which may be lamps or light emitting diodes—for example). The number of lights 18 which are lit is generally dependent on the signal representative of the moment of tilt as received by the controller 12. Control of the lights 18 may be achieved by the controller 12. In an embodiment, the indicator 17 sounds an alarm and an aspect of the alarm (e.g. pitch or frequency) may vary in general dependence on the signal representative of the signal representative of the moment of tilt as received by the controller 12. In particular, the controller 12 may issue a signal to control the indicator 17. The signal may be the same signal as is issued by the controller 12 to restrict or substantially prevent a movement of the load handling apparatus 6, 7 or may be a further signal. In an embodiment, the indicator 17 receives the signal representative of the moment of tilt as is also received by the controller 12. The controller 12 may issue a signal to the indicator 17 which is used by the indicator 17 to determine the operation of the indicator 17. For example, the controller 12 may issue a scaling factor signal (see below) to the indicator 17 which the indicator 17 may apply to the signal representative of the moment of tilt; the resulting scaled signal may be used to operate the indicator 17.

The lights are, in an embodiment, color coded—with one or more green lights being lit when that moment of tilt is below the relevant threshold value as determined by the controller 12 and one or more amber or red lights being lit (or flashed) when the relevant threshold value is close or is approaching. An alarm of the indicator 17 may be sounded, in an embodiment, when the relevant threshold is close or approaching. The alarm may be silent when the relevant threshold is not close or approaching.

In accordance with an embodiment, a scaling factor which is dependent on the signal representative of the orientation of the load handling apparatus 6, 7 is applied to the signal representative of the moment of tilt in order to determine the number of lights 18 which are to be lit. This scaling factor may be inversely proportional to the signal representative of the orientation of the load handling apparatus 6, 7. This use of a scaling factor may occur in the controller 12 or in the indicator 17.

Therefore, the moment of tilt which causes the indicator 17 to indicate that the machine 1 is at risk of tipping varies in dependence on the orientation of the load handling apparatus 6, 7.

The dependence on the orientation of the load handling apparatus 6, 7, seeks to ensure that the operation of the indicator 17 can be easily understood by the operator. If the indicator 17 operated solely based on the signal representative of the moment of tilt of the machine 1 then, for example, the number of lights 18 lit when the machine 1 is at risk of tipping would vary. This would be confusing for the operator.

The indicator 17 may take many different forms and need not be a plurality of lights 18 as described above but could be a numerical indicator which displays a numerical value representative of the stability of the machine 1. The indicator 17 also need not be in the cab 3 but may be provided elsewhere in a location in which it can be viewed and/or heard by an operator.

In an embodiment, the indicator 17 includes a light which flashes and/or an alarm that sounds when the controller 12 issues a signal to restrict or substantially prevent a movement of the load handling apparatus 6, 7.

In an embodiment, the indicator 17 is provided and the controller 12 is coupled to the indicator 17. A signal issued by the controller 12 to the indicator 17 controls operation of the indicator 17 and the controller 12 may or may not also be operable to restrict or substantially prevent movement of the load handling apparatus 6, 7.

It will be appreciated that a signal issued by the controller 12 is for use by an element 16 (see FIG. 3) of a machine 1 to control an aspect of an operation of the machine 1 and that two examples of that operation are: restricting or substantially preventing a movement of the load handling apparatus 6, 7; and displaying and/or sounding a warning. Control of other operations is also possible. To this end, the controller 12 may be coupled to an element 16 of the machine which includes, for example, an indicator 17 or a device which restricts or substantially prevents a movement of the load handling apparatus 6, 7 (which might be a movement actuator, a part thereof, or a control element for a movement actuator).

Although the teachings above have been discussed in relation to the lowering of a load from an elevated orientation, the teachings may also be applied in reverse. I.e. it is possible that in extreme conditions of lifting of a load whilst the machine is positioned on a steep upward incline, a sudden cessation of lifting could cause a rearward tipping of the machine about the rear axle A2. The tilt sensing arrangement 13 may be configured to monitor for a rearward moment of tilt 13. In an embodiment, the tilt sensing arrangement 13 includes a strain gauge coupled to an axle A1 of the machine 1 to monitor for rearward tilt. In an embodiment, the tilt sensing arrangement 13 includes a load cell located between the machine body 2 and an axle and configured to sense the load (or weight) on the axle. The tilt sensing arrangement 13 may be coupled to or otherwise associated with the first (or front) axle A1.

In certain embodiments, a relative position of the load handling apparatus with respect to the machine body may also be sensed. This may be achieved by placing a further absolute orientation sensor (e.g. an accelerometer) on the machine body 2 and comparing the values of the two absolute orientation sensors to obtain a relative position. Alternatively a potentiometer or actuator extension sensor may be used as described above.

The relative position may be utilized to control certain machine interlocks that may be confusing to an operator if they are determined from absolute orientation values. Examples of such interlocks may be for stabilizer isolation, sway isolation of a pivoting axle, and the maximum lift angle of the load handling apparatus before the stabilizer must be deployed. In other embodiments these interlocks may nevertheless be determined by a relative orientation value.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the teachings in diverse forms thereof. It will be appreciated that numerous changes may be made within the scope of the present teachings.

The invention claimed is:

1. A controller for use with a machine comprising a machine body, and a load handling apparatus coupled to the machine body and moveable by a movement actuator with respect to the machine body, wherein the controller is configured to receive a signal representative of an orientation of the load handling apparatus with respect to a reference orientation, wherein the reference orientation is an absolute orientation that is configured to be fixed in space irrespective of the orientation of the machine itself and wherein the reference orientation is gravity or a horizontal level, and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the orientation of the load handling apparatus with respect to the reference orientation.

2. The controller according to claim 1, wherein the element of the machine includes an indicator of the machine which, in response to the signal issued by the controller, is configured to display and/or sound a warning.

3. The controller according to claim 1, wherein the controller is further configured to receive a signal representative of whether one or more stabilizers of the machine are deployed, and the threshold value is further dependent on the signal representative of whether one or more of the stabilizers of the machine are deployed.

4. The controller according to claim 1, wherein the signal representative of the orientation of the load handling apparatus is a signal representative of an angle of the load handling apparatus with respect to the reference orientation.

5. The controller according to claim 1 wherein the threshold value has a first threshold value corresponding to a first orientation of the load handling apparatus with respect to the reference orientation and the threshold value has a second threshold value corresponding to a second orientation of the load handling apparatus with respect to the reference orientation, the first threshold value being less than the second threshold value and the first orientation being lower than the second orientation.

6. The controller according to claim 1, wherein the signal representative of the moment of tilt of the machine is a signal representative of a load on an axle of the machine.

7. The controller according to claim 1, wherein the threshold value includes a first threshold value associated with one or more predetermined orientations of the load handling apparatus and a second threshold value associated with one or more other predetermined orientations of the load handling apparatus.

8. The controller according to claim 7, wherein the threshold value is proportional or substantially proportional to the signal representative of the orientation of the load handling apparatus over a range of orientations of the load handling apparatus.

9. The controller according to claim 8, wherein the range of orientations of the load handling apparatus is between a first and a second orientation of the load handling apparatus, and at least one different threshold value is used when a position of the load handling apparatus is outside of the range.

10. The controller according to claim 1, further configured to receive a signal representative of a position of the load handling apparatus relative to the machine body.

11. The controller according to claim 10, wherein the controller is configured to issue a signal to set an interlock based on the position of the load handling apparatus relative to the machine body.

12. A control system for use with a machine comprising a machine body, and a load handling apparatus coupled to the machine body and moveable by a movement actuator with respect to the machine body, the control system incorporating a controller, the controller being configured to receive a signal representative of an orientation of the load handling apparatus with respect to a reference orientation, wherein the reference orientation is an absolute orientation that is configured to be fixed in space irrespective of the orientation of the machine itself and wherein the reference orientation is gravity or a horizontal level, and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the orientation of the load handling apparatus with respect to the reference orientation.

13. The control system according to claim 12, and further comprising an absolute orientation sensor configured to send a signal representative of the orientation of the load handling apparatus with respect to the reference orientation.

14. A machine comprising a load handling apparatus, a machine body and a movement actuator, the load handling apparatus being coupled to the machine body and moveable by the movement actuator with respect to the machine body, the machine incorporating a controller configured to receive a signal representative of an orientation of the load handling apparatus with respect to a reference orientation, wherein the reference orientation is an absolute orientation that is configured to be fixed in space irrespective of the orientation of the machine itself and wherein the reference orientation is gravity or a horizontal level, and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the orientation of the load handling apparatus with respect to the reference orientation.

15. The machine according to claim 14 wherein the load handling apparatus comprises a lifting arm, the lifting arm being at least pivotable with respect to the machine body.

16. The machine according to claim 15 wherein the lifting arm is pivotable about a substantially transverse axis of the machine and the lifting arm extends substantially parallel to a longitudinal axis of the machine.

17. The machine according to claim 15 wherein the lifting arm is pivotable about a location between a longitudinal mid-point of the machine body and a rear of the machine body.

18. The machine according to claim 15 wherein a load handling implement is mountable to the lifting arm forward of the machine body.

19. The machine according to claim 14 wherein the machine further comprises a ground engaging propulsion structure to permit movement thereof over a ground surface.

20. A method of controlling a machine comprising a machine body, a load handling apparatus coupled to the machine body and moveable with respect to the machine body, and a controller, the method comprising:

Receiving, by the controller, a signal representative of an orientation of the load handling apparatus with respect to a reference orientation, wherein the reference orientation is an absolute orientation that is configured to be fixed in space irrespective of the orientation of the machine itself and wherein the reference orientation is gravity or a horizontal level, and a signal representative of a moment of tilt of the machine;

Comparing, by the controller, a signal representative of the moment of tilt with a threshold value, the threshold value being dependent on the signal representative of the orientation of the load handling apparatus with respect to the reference orientation; and Issuing, by the controller, a signal for use by an element of the machine to restrict or substantially prevent a movement of the load handling apparatus in response to the issued signal when the signal representative of the moment of tilt reaches the threshold value.

21. The method according to claim 20, further comprising displaying and/or sounding a warning in response to the signal issued by the controller.

22. The method according to claim 20, further comprising receiving a signal representative of whether one or more stabilizers of the machine are deployed, wherein the threshold value is further dependent on the signal representative of whether one or more of the stabilizers of the machine are deployed.

23. The method according to claim 20, wherein the signal representative of the orientation of the load handling apparatus is a signal representative of an angle of rotation of a lifting arm of the load handling apparatus with respect to the reference orientation.

24. The method according to claim 20, wherein the signal representative of the moment of tilt of the machine is a signal representative of a load on an axle of the machine.

25. The method according to claim 20, wherein the threshold value includes a first threshold value associated with one or more predetermined orientations of the load handling apparatus and a second threshold value associated with one or more other predetermined orientations of the load handling apparatus.

26. The method according to claim 25, wherein the threshold value is proportional or substantially proportional to the signal representative of the orientation of the load handling apparatus over a range of positions of the load handling apparatus.

27. The method according to claim 26, wherein the range of orientations of the load handling apparatus is between a first and a second orientation of the load handling apparatus, and at least one different threshold value is used when the orientation of the load handling apparatus is outside of the range.

28. The method according to claim 20, wherein the machine body is positioned on an incline with respect to level ground.

* * * * *